US007365283B2

(12) United States Patent
Kiyono et al.

(10) Patent No.: US 7,365,283 B2
(45) **Date of Patent: *Apr. 29, 2008**

(54) SWITCH

(75) Inventors: Yasuhiro Kiyono, Nagaokakyo (JP); Toshihiro Naruo, Kyoto (JP); Yasuhiro Sakashita, Nara (JP)

(73) Assignee: Omron Corporation, Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/415,449

(22) Filed: May 1, 2006

(65) Prior Publication Data

US 2006/0254889 A1 Nov. 16, 2006

(30) Foreign Application Priority Data

May 2, 2005 (JP) ..... 2005-134231

(51) Int. Cl.
*H01H 15/02* (2006.01)

(52) U.S. Cl. ..... 200/563; 200/553; 200/559; 200/276.1

(58) Field of Classification Search .... 200/16 R–16 D, 200/520, 530–536, 553, 557–559, 561–563, 200/276.1, 61.82
See application file for complete search history.

(56) References Cited

FOREIGN PATENT DOCUMENTS

| | | |
|---|---|---|
| EP | 1 261 002 | 11/2002 |
| JP | 61-51623 | 4/1986 |
| JP | 61-71934 | 5/1986 |
| JP | 62-86034 | 6/1987 |
| JP | 64-23823 | 2/1989 |
| JP | 8-55538 | 2/1996 |
| JP | 2002-42610 | 2/2002 |
| JP | 2004-327115 | 11/2004 |
| WO | WO-02/37517 | 5/2002 |

OTHER PUBLICATIONS

Patent Abstracts of Japan, Publication No. 2004-327115, Publication Date: Nov. 18, 2004, 14 pages.
Japanese Office Action for Japanese Patent Application No. 2005-134231, issued Apr. 10, 2007, and English translation thereof 6 pages.
Japanese Office Action for Japanese Patent Application No. 2005-134231, dated Aug. 21, 2007, and English Translation thereof, 13 pages.

*Primary Examiner*—Michael A Friedhofer
(74) *Attorney, Agent, or Firm*—Osha Liang LLP

(57) ABSTRACT

A switch is provided, which is stable in operating characteristics and can be operated with a small operating force, and which is long in life and easy to manufacture. The switch includes a base, a moving contact piece having one end thereof supported pivotally on the base, an operating lever supported pivotally on the base and having a drive part pushing a coil portion of the moving contact piece, and a cover having a planar shape capable of covering the base and fixed to the base to compress the coil portion. The operating lever pushes the coil portion of the moving contact piece whereby the moving contact piece turns about an end thereof, the coil portion slides on a stationary contact exposed from a bottom surface of the base, and the other end of the moving contact piece slides on a common stationary contact exposed from an inner surface of the base.

16 Claims, 14 Drawing Sheets

(A)

(B)

(A)

(B)

(C)

(A)

(B)

(C)

(A)

(B)

(A)

(B)

(A)

(B)

(C)

(A)

(B)

(C)

SWITCH

BACKGROUND OF THE INVENTION

1. Field of the Invention

The present invention relates to a switch, and more particular, to a thin-type switch mountable on a printed board.

2. Description of Related Art

Conventionally, a thin-type switch mountable on a printed board includes, for example, a housing having a space therein, a first stationary terminal having an end provided outside the housing and the other end provided inside the housing and provided with a contact portion having a contact groove, a second stationary terminal having an end provided outside the housing and the other end provided inside the housing and provided with a contact portion, a contact piece provided in the housing, provided at an end thereof with a stationary portion, which is latched in the contact groove of the first stationary terminal to contact with the contact portion of the first stationary terminal, and at the other end thereof with a moving portion capable of contacting with the contact portion of the second stationary terminal, the contact piece being biased by a coil spring formed at an intermediate portion thereof in a direction of twist and in a direction of compression, and an operating body provided at a base end thereof with a support portion, which is provided in the housing and defines a center of swinging, the remaining portion thereof being capable of swinging about the support portion as the center of swinging, and formed with a push surface, which abuts against the contact piece, the operating body swinging to enable pushing the contact piece in the direction of twist (see JP-A-2004-327115).

With the switch described above, however, the operating body 60 directly pushes the moving portion 50*e* being one end of the contact piece 50 made of a coil spring, and the contact portion 50*g* of the operating body slides on the contact portion 40*c* of the second stationary terminal 40 while twisting the contact piece 50. Therefore, when the operating body 60, the contact piece 50, etc. involve dispersion in outside dimension and assembly accuracy, unexpected elastic deformation such as warping of the moving portion 50*e*, or the like is liable to occur. Consequently, dispersion is liable to generate in contact pressure, at which the contact portion 50*g* of the operating body contacts with the contact portion 40*c*, and so the operating characteristics are liable to become unstable. Accordingly, when it is tried to ensure a desired operating characteristics, the switch described above needs high part accuracy and assembly accuracy, so that manufacture is not easy.

Also, in order to perform contact switchover in the switch described above, it is necessary to increase a twist angle of the moving portion 50*e*. Therefore, there is caused a problem that a large operating force is necessary and a torsional moment acting on the contact piece 50 becomes large to make the switch susceptible to fatigue and short in life.

SUMMARY OF THE INVENTION

In view of the problem described above, the invention has its object to provide a switch, which has the stable operating characteristics, can be operated with a small operating force and is long in life and easy in manufacture.

In order to solve the problem, a switch according to the invention has a construction including a base, a moving contact piece made of a coil spring and having one end thereof supported pivotally on the base, an operating lever having one end thereof supported pivotally on the base and having a drive part, which extends from the one end, pushing a coil portion of the moving contact piece, and a cover having a planar shape capable of covering the base and fixed to the base to compress the coil portion, and in which the operating lever pushes the coil portion of the moving contact piece to give thereto a torsional moment whereby the moving contact piece turns about an end thereof, the coil portion of the moving contact piece slides on at least one stationary contact exposed from a bottom surface of the base, and the other end of the moving contact piece slides on a common stationary contact exposed from an inner surface of the base.

According to the invention, since the drive part of the operating lever pushes the coil portion of the moving contact piece, which is made of a coil spring, the other end of the moving contact piece is hard to be subjected to unexpected elastic deformation and it is possible to ensure a predetermined contact pressure, so that a switch is obtained, which is stable in operating characteristics.

Also, even when the base, the operating lever, etc. involve dispersion in dimensional accuracy and assembly accuracy, the moving contact piece is elastically deformed to absorb an error, so that high part accuracy and assembly accuracy are not needed and manufacture is easy.

Further, since the moving contact piece turns about an end thereof and the other end thereof slides, a twist angle of the whole moving contact piece is smaller than that in the related art. Therefore, there is produced an effect that a torsional moment acting on the moving contact piece is small, a large operating force is not necessary, and a switch is obtained, which is hardly susceptible to fatigue and long in life.

According to the embodiment of the invention, the stationary contact exposed from the bottom surface of the base may include a normally opened stationary contact, or a normally closed stationary contact, or a normally opened stationary contact and a normally closed stationary contact.

According to the embodiment, there is obtained a switch, for which freedom in selecting a product is increased and which is wide in usage.

A switch according to another invention has a construction including a base, a moving contact piece made of a coil spring and having one end thereof supported pivotally on the base, an operating lever having one end thereof supported pivotally on the base and having a drive part, which extends from the one end, pushing a coil portion of the moving contact piece, and a cover having a planar shape capable of covering the base and fixed to the base to compress the coil portion, and in which the operating lever pushes the coil portion of the moving contact piece to give thereto a torsional moment whereby the moving contact piece turns about an end thereof, the coil portion of the moving contact piece slides on a common stationary contact exposed from a bottom surface of the base, and the other end of the moving contact piece slides on at least one stationary contact exposed from an inner surface of the base.

According to the invention, since the drive part of the operating lever pushes the coil portion of the moving contact piece, which is made of a coil spring, the other end of the moving contact piece is hard to be subjected to unexpected elastic deformation and it is possible to ensure a predetermined contact pressure, so that a switch is obtained, which is stable in operating characteristics.

Also, even when the base, the operating lever, etc. involve dispersion in dimensional accuracy and assembly accuracy, the moving contact piece is elastically deformed to absorb an error, so that high part accuracy and assembly accuracy are not needed and manufacture is easy.

Further, since the moving contact piece turns about an end thereof and the other end thereof slides, a twist angle of the whole moving contact piece is smaller than that in the related art. Therefore, there is produced an effect that a torsional moment acting on the moving contact piece is small, a large operating force is not necessary, and a switch is obtained, which is hardly susceptible to fatigue and long in life.

According to the embodiment of the invention, the stationary contact exposed from the inner surface of the base may include a normally opened stationary contact, a normally closed stationary contact, or a normally opened stationary contact and a normally closed stationary contact.

According to the embodiment, there is obtained a switch, for which freedom in selecting a product is increased and which is wide in usage.

A switch according to a further invention has a construction including a base, a moving contact piece made of a coil spring and having one end thereof supported pivotally on the base, an operating lever having one end thereof supported pivotally on the base and having a drive part, which extends from the one end, pushing a coil portion of the moving contact piece, and a cover having a planar shape capable of covering the base and fixed to the base to compress the coil portion, and in which the operating lever pushes the coil portion of the moving contact piece to give thereto a torsional moment whereby the moving contact piece turns about an end thereof, the coil portion of the moving contact piece slides on at least two stationary contacts exposed from a bottom surface of the base, and the other end of the moving contact piece slides on an inner surface of the base.

According to the invention, since the drive part of the operating lever pushes the coil portion of the moving contact piece, which is made of a coil spring, the other end of the moving contact piece is hard to be subjected to unexpected elastic deformation and it is possible to ensure a predetermined contact pressure, so that a switch is obtained, which is stable in operating characteristics.

Also, even when the base, the operating lever, etc. involve dispersion in dimensional accuracy and assembly accuracy, the moving contact piece is elastically deformed to absorb an error, so that high part accuracy and assembly accuracy are not needed and manufacture is easy.

Further, since the moving contact piece turns about an end thereof and the other end thereof slides, a twist angle of the whole moving contact piece is smaller than that in the related art. Therefore, there is produced an effect that a torsional moment acting on the moving contact piece is small, a large operating force is not necessary, and a switch is obtained, which is hardly susceptible to fatigue and long in life.

According to the embodiment of the invention, at least two stationary contacts exposed from the bottom surface of the base may include a common stationary contact and a normally opened stationary contact, or a common stationary contact and a normally closed stationary contact, or a common stationary contact, a normally opened stationary contact, and a normally closed stationary contact.

According to the embodiment, there is obtained a switch, for which freedom in selecting a product is increased and which is wide in usage.

A switch according to a different invention has a construction including a base, a moving contact piece made of a coil spring and having one end thereof supported pivotally on the base, an operating lever having one end thereof supported pivotally on the base and having a drive part, which extends from the one end, pushing a coil portion of the moving contact piece, and a cover having a planar shape capable of covering the base and fixed to the base to compress the coil portion, and n which the operating lever pushes the coil portion of the moving contact piece to give thereto a torsional moment whereby the moving contact piece turns about an end thereof, the coil portion of the moving contact piece slides on at least two stationary contacts exposed from a bottom surface of the base, and the other end of the moving contact piece comes into pressure contact with an inner surface of the base.

According to the invention, since the drive part of the operating lever pushes the coil portion of the moving contact piece, which is made of a coil spring, the other end of the moving contact piece is hard to be subjected to unexpected elastic deformation and it is possible to ensure a predetermined contact pressure, so that a switch is obtained, which is stable in operating characteristics.

In particular, the coil portion slides on at least two stationary contacts, so that a switch is obtained, in which dispersion is hard to generate in contact pressure and further stable in operating characteristics.

Also, even when the base, the operating lever, etc. involve dispersion in dimensional accuracy and assembly accuracy, the moving contact piece is elastically deformed to absorb an error, so that high part accuracy and assembly accuracy are not needed and manufacture is easy.

According to the embodiment of the invention, at least two stationary contacts exposed from the bottom surface of the base may include a common stationary contact and a normally opened stationary contact, or a common stationary contact and a normally closed stationary contact, or a common stationary contact, a normally opened stationary contact, and a normally closed stationary contact.

The embodiment produces an effect that there is obtained a switch, for which freedom in selecting a product is increased and which is wide in usage.

DETAILED DESCRIPTION OF THE INVENTION

Figure 1:
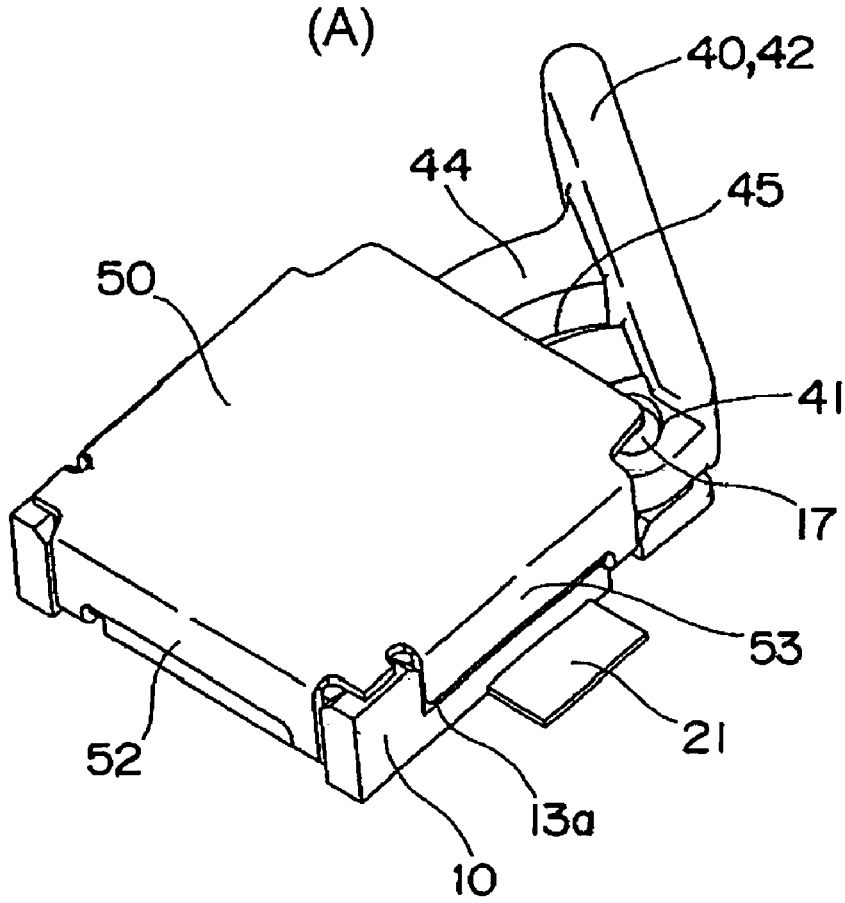
FIG. 1A is a perspective view showing the whole of a first embodiment of a switch according to the invention.
FIG. 1B is a perspective view showing contact terminals being insert-molded into a base.
Figure 1:
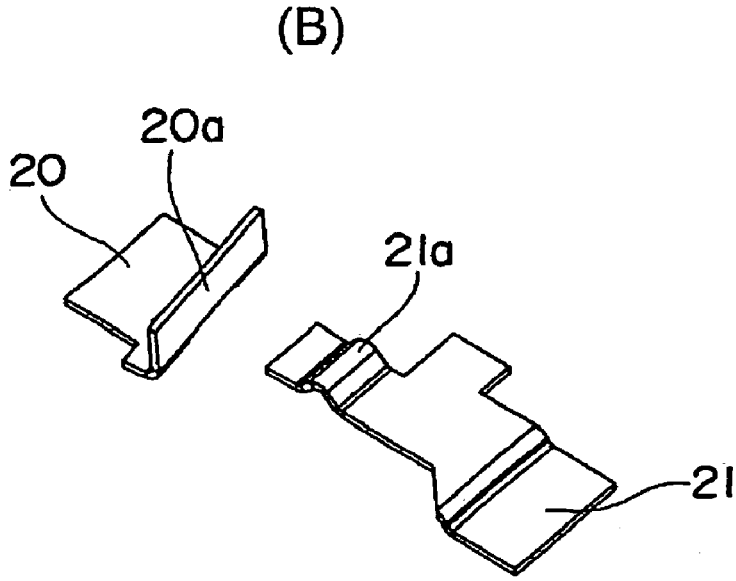

Embodiments of the invention will be described below with reference to the accompanying drawings of FIGS. 1 to 14.

A first embodiment includes, as shown in FIGS. 1 to 6, a base 10, into which stationary contact terminals 20, 21 are insert-molded, and which is square in plan, a moving contact piece 30 made of a coil spring, an operating lever 40 supported pivotally on the base 10, and a cover 50 that covers the base 10. In addition, an exemplary product as actually assembled has an outside dimension of a total height 0.9 mm, a base width of 3.0 mm, and a length of 3.5 mm.

The base 10 includes substantially U-shaped side walls 11, 12, 13 provided continuously and protrusively along a peripheral edge of an upper surface thereof, and the stationary contact terminals 20, 21, respectively, are insert-molded on the opposite side walls 11, 13. Positioning steps 11*a*, 13*a*, respectively, are provided on outer side surfaces of the side walls 11, 13, on which the stationary contact terminals 20, 21 are insert-molded, while a positioning recess 12*a* is formed on an outer side surface of the side wall 12 positioned between the side walls 11, 13. Further, a low step 13*b* is formed on an inside edge of the upper surface of the side wall 13, on which the stationary contact terminal 21 is insert-molded, and a latch hole 14 is provided on the step 13*b* to have an end 32 of the moving contact piece 30 latched thereon. Also, a common stationary contact 20*a* of the stationary contact terminal 20 is exposed from an inner surface of the side wall 11, on which the stationary contact terminal 20 is insert-molded, and a normally opened stationary contact 21*a* of the stationary contact terminal 21 is exposed from a surface of a ridge 15 protrusively provided on a bottom surface of the base 10. Further, the base 10 includes spindles 16, 17 protrusively provided at adjacent corners on that outer peripheral edge of the upper surface, which is not provided with any side wall, to support the operating lever 40 described later, and a coming-off preventive projection 18 protrusively provided between the spindles 16, 17 to prevent coming-off of the operating lever 40.

The moving contact piece 30 made of a coil spring is pivotally supported by latching the end 32 thereof, which extends from an upper end of a coil portion 31 to be bent, on the latch hole 14 of the base 10. On the other hand, the other bent end 33 functioning as a moving contact contacts with the common stationary contact 20*a* at all times. The coil portion 31 of the moving contact piece 30 functioning as a moving contact is arranged in a manner to slide on a surface of the ridge 15 of the base 10 to be able to contact with or separate from the stationary contact 21*a*.

The operating lever 40 has an axial hole 41 positioned in a central position of a substantially sector shape in plan view and fitted rotatably onto the spindles 16, 17 of the base 10. An operating part 42 and a drive part 43 extend at a predetermined angle about the axial hole 41, and an arcuate groove 45 about the axial hole 41 is formed by connecting the operating part 42 and the drive part 43 to each other by means of a reinforcement rib 44. In addition, the axial hole 41 of the operating lever 40 can be fitted on either of the spindles 16, 17 of the base 10, and the drive part 43 is shaped to be able to appropriately drive the moving contact piece 30 even in the case where the operating lever 40 is supported by either of the spindles 16, 17.

The cover 50 has a planar shape to enable covering the base 10. However, an insulating sheet (not shown) may be stuck integrally to a roof surface of the cover at need. The cover 50 is bent vertically from three adjacent outer peripheral edges to form engagement tongue pieces 51 (not shown), 52, 53, and bendable pawls 51*a* (not shown), 52*a*, 53*a*, respectively, are extended from lower end edges of the tongue pieces 51, 52, 53.

Subsequently, an explanation will be given to a method of assembling the switch according to the embodiment.

First, the end 32 of the moving contact piece 30 is latched and supported pivotally on the latch hole 14 of the base 10, into which stationary contact terminals 20, 21 are insert-molded, to be accommodated on the upper surface of the base 10. Thereby, the other end 33 of the moving contact piece 30 is brought into contact with the common stationary contact 20*a*, and the coil portion 31 is placed slidably on the upper surface of the ridge 15. The axial hole 41 of the operating lever 40 is fitted on, for example, the spindle 17 of the base 10 to be supported pivotally thereon. Then, the cover 50 is put on the base 10 to be pushed thereagainst whereby the tongue pieces 51, 53 and the tongue piece 52, respectively, are engaged by the positioning steps 11*a*, 13*a* and the recess 12*a* to be positioned. Thereby, the coil portion 31 is compressed, so that a lowermost end surface of the coil portion 31 can contact with the stationary contact 21*a* at a predetermined contact pressure. When the operating lever 40 is pushed inward against the spring force of the moving contact piece 30 in this state, the drive part 43 gets over the coming-off preventive projection 18 and the projection 18 is latched in the arcuate groove 45. Therefore, even when the operating lever 40 is biased outward by the moving contact piece 30, it is prevented from coming off and the other end 33 of the moving contact piece 30 is brought into pressure contact with the common stationary contact 20*a* at a predetermined contact pressure. Thereafter, the assembling work is completed by inward bending the engagement pawls 51*a*, 52*a*, 53*a* of the tongue pieces 51, 52, 53 and fixing the cover 50 to the base 10.

Subsequently, an explanation will be given to a method of operating the switch.

In the case where any operating force is not exerted on the operating lever 40, the lowermost end surface of the coil portion 31 is brought into pressure contact with the surface of the ridge 15 at a predetermined contact pressure since the coil portion 31 of the moving contact piece 30 is compressed and interposed by the base 10 and the cover 50. Also, a spring force generated on the moving contact piece 30 by an action of beforehand loaded twist causes the other end 33 to be brought into pressure contact with the common stationary contact 20*a*. Further, an outward pushing bias force acts on the operating lever 40 but the coming-off preventive projection 18 serves as prevention of coming-off.

When the operating part 42 of the operating lever 40 is pushed in, the drive part 43 pushes the coil portion 31. Therefore, the torsional moment of the coil portion 31 increases, so that the operating lever 40 turns about the spindle 17 against the spring force of the moving contact piece 30 and the other end 33 moves sliding on the common stationary contact 20*a*. Therefore, the coil portion 31 of the moving contact piece 30 slides along the surface of the ridge 15 and the lowermost surface of the coil portion 31 comes into contact with the stationary contact 21*a*.

When a load on the operating lever 40 is released, the operating lever 40 is pushed back outward by the spring force of the moving contact piece 30. Therefore, the moving contact piece 30 turns about the end 32 of the moving contact piece 30 in a reverse direction to the direction described above, the other end 33 thereof slides on the stationary contact 20*a*, and the lowermost surface of the coil portion 31 slides on the stationary contact 21*a* to effect opening.

According to the embodiment, the moving contact piece 30 turns deforming elastically to open and close the contact whereby a switch is obtained, which does not need as high part accuracy and assembly accuracy as those in the related art, and which is high in productivity and stable in operating characteristics.

In particular, since the other end 33 of the moving contact piece 30 moves sliding on the stationary contact 20*a*, a twist angle generated on the moving contact piece 30 is small as compared with the case where the other end does not move. Therefore, an internal stress generated on the moving contact piece 30 is small and fatigue failure is hard to occur.

Further, according to the embodiment, not only an operation in a counterclockwise direction but also an operation in a clockwise direction can be accommodated by fitting the operating lever 40 onto the spindle 16 as shown in FIG. 7A. Therefore, since parts can be used in common, a single metallic mold can serve, thus enabling reduction in production cost. Consequently, according to the embodiment, there is an advantage that a switch affording operation in three directions can be obtained by a single kind of metallic mold.

A second embodiment provides a normally closed contact type, in which a normally closed stationary contact is arranged on a bottom surface of a base 10 as shown in FIG. 7B and FIGS. 8 to 11.

Figure 8:
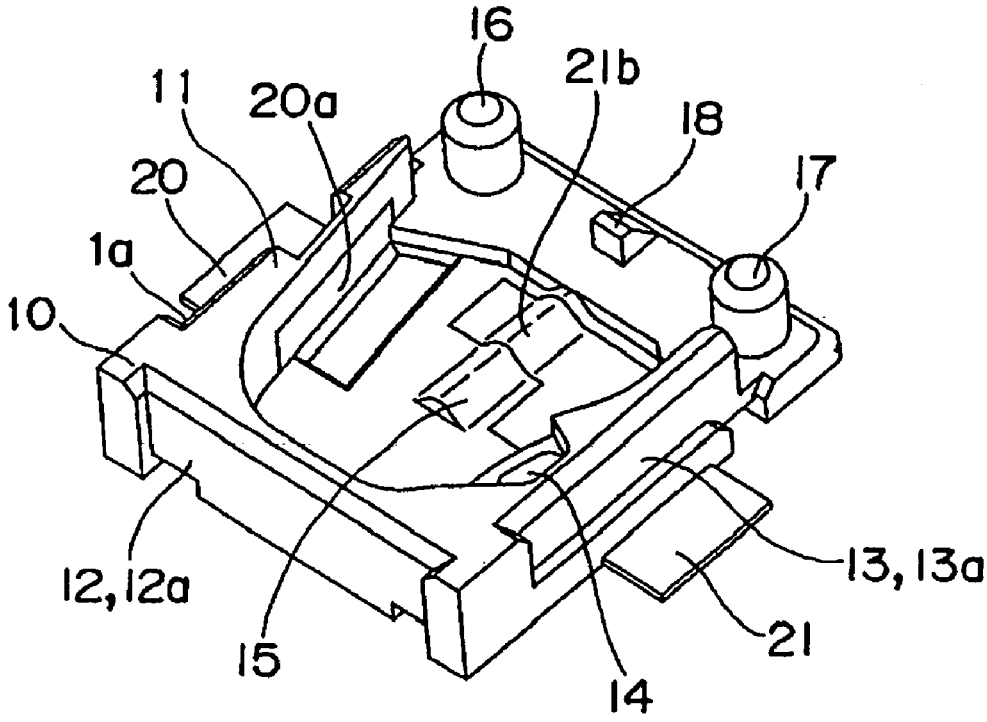
FIGS. 8A and 8B are perspective views showing a base and contact terminals according to the second embodiment shown in FIG. 7B.
Figure 8:
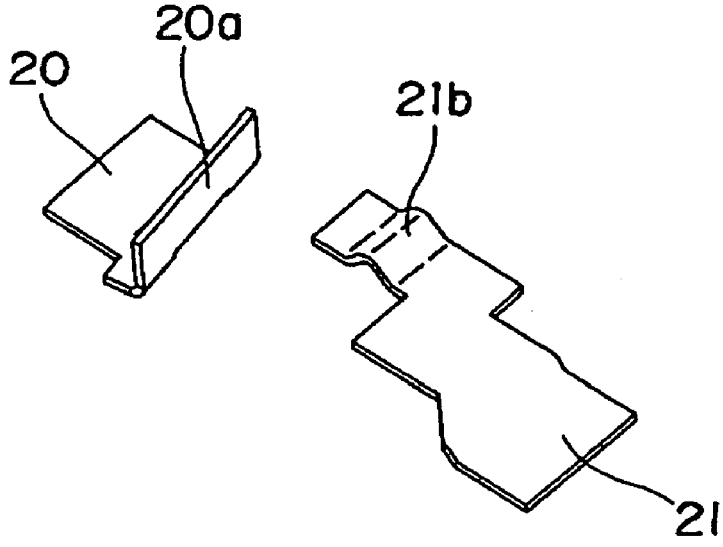
Figure 9:
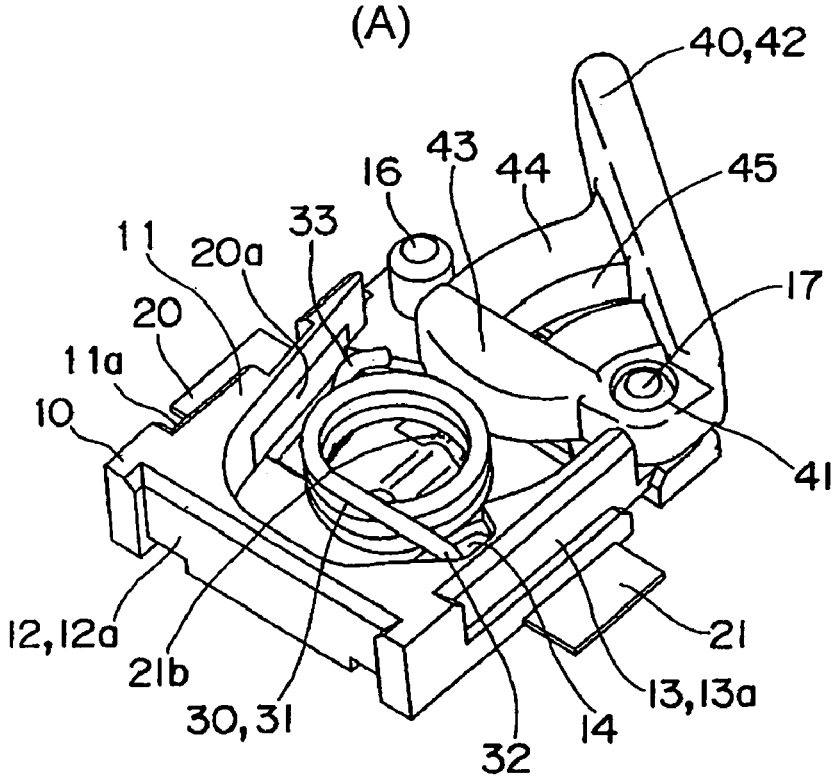
FIGS. 9A and 9B are perspective views showing a switch according to the second embodiment shown in FIG. 7B before and after operation.
Figure 9:
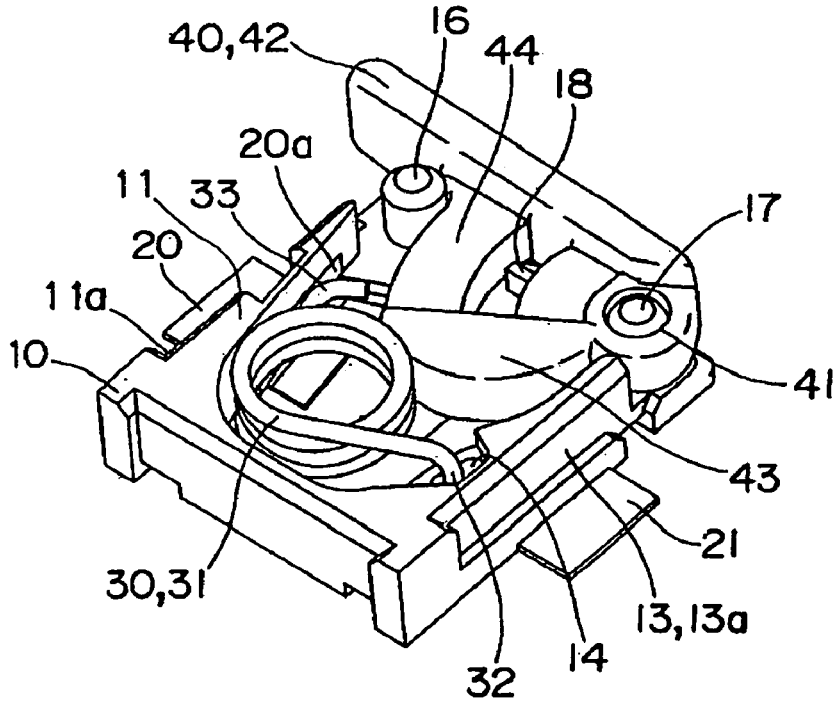
Figure 10:
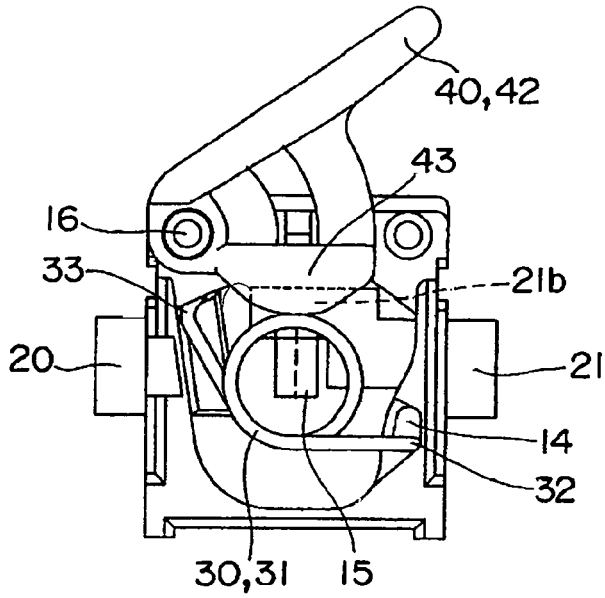
FIGS. 10A, 10B, and 10C are plan views showing the switch according to the second embodiment shown in FIG. 7B before, during, and after operation.
Figure 10:
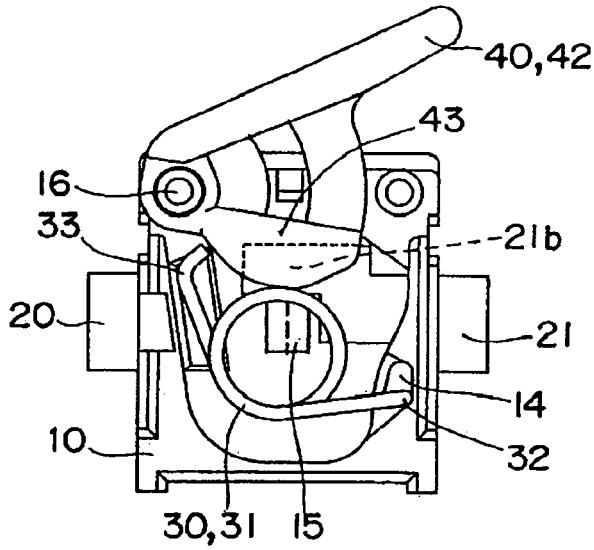
Figure 10:
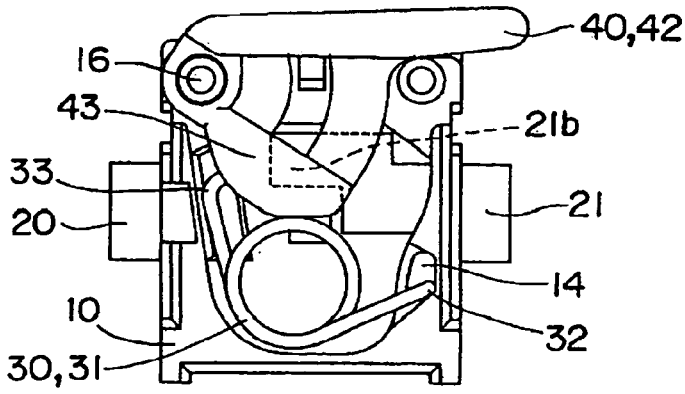
Figure 11:
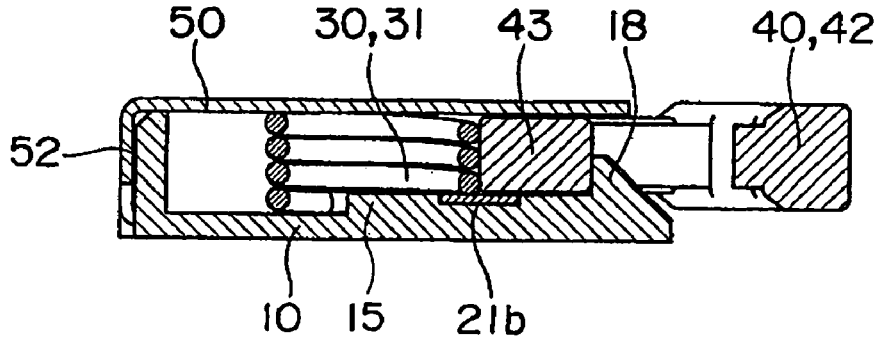
FIGS. 11A, 11B, and 11C are cross sectional views showing the switch according to the second embodiment shown in FIG. 7B before, during, and after operation.
Figure 11:
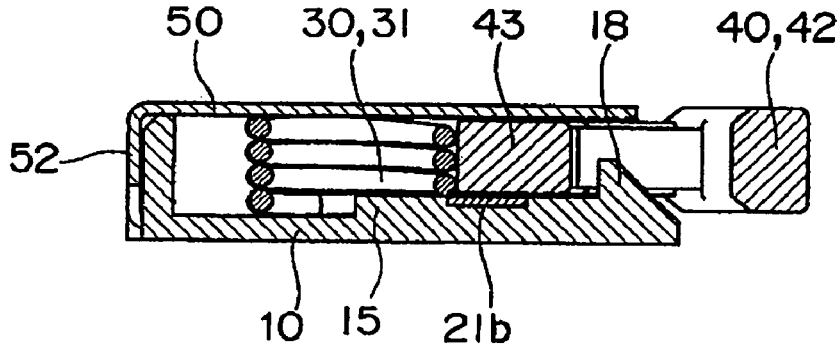
Figure 11:
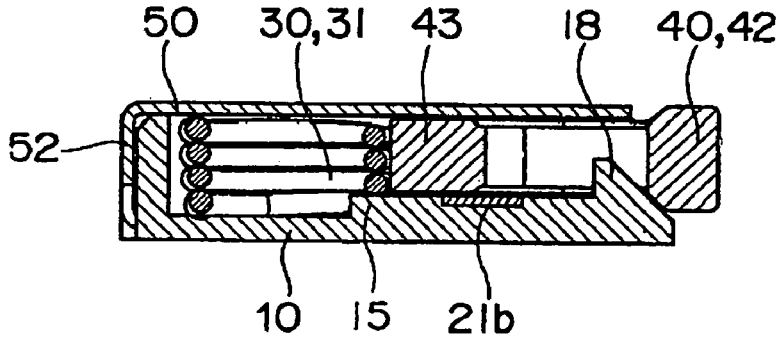
Figure 12:
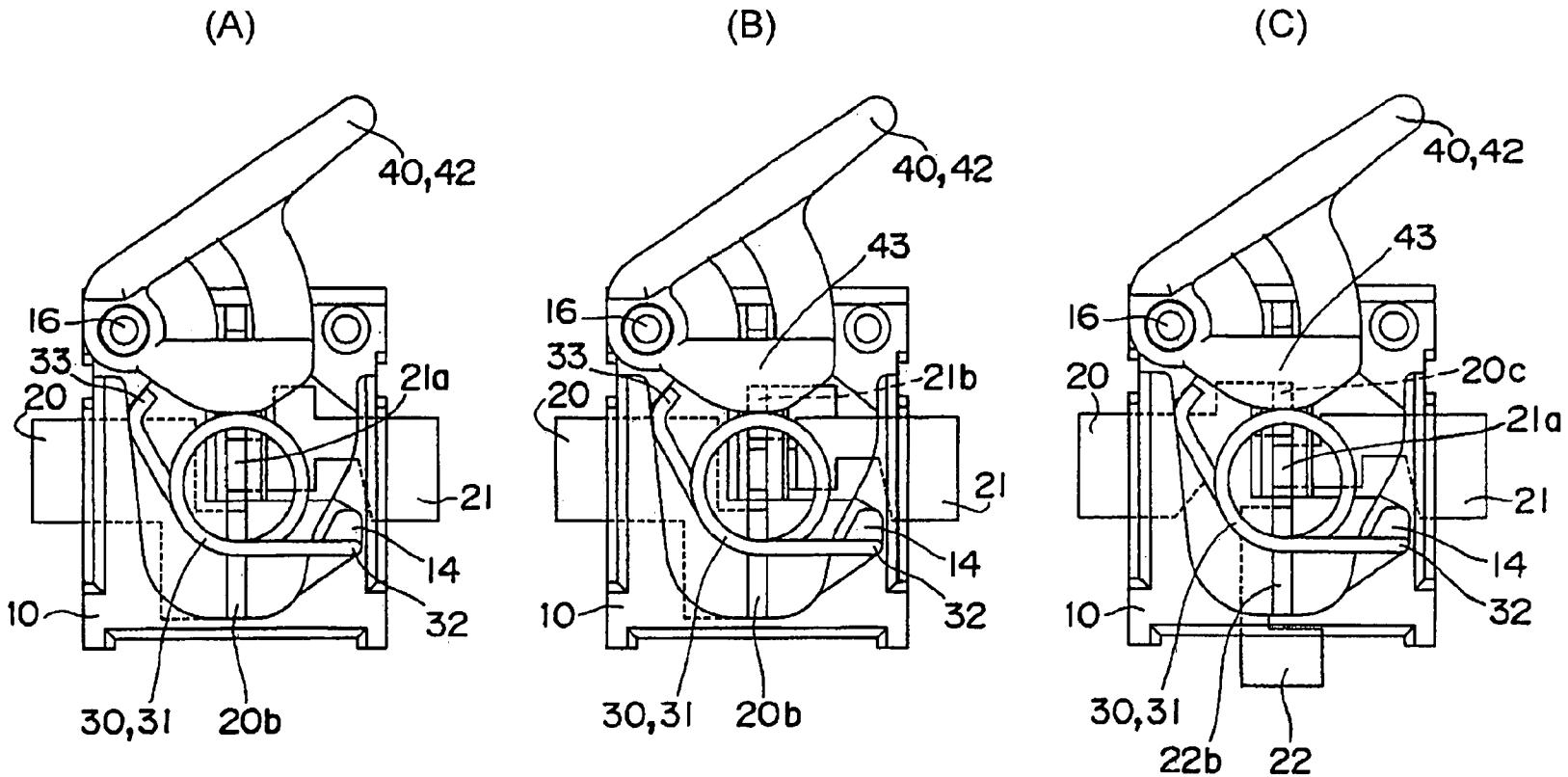
FIGS. 12A, 12B, and 12C are plan views showing fourth, fifth, and sixth embodiments of switches according to the invention.
Figure 13:
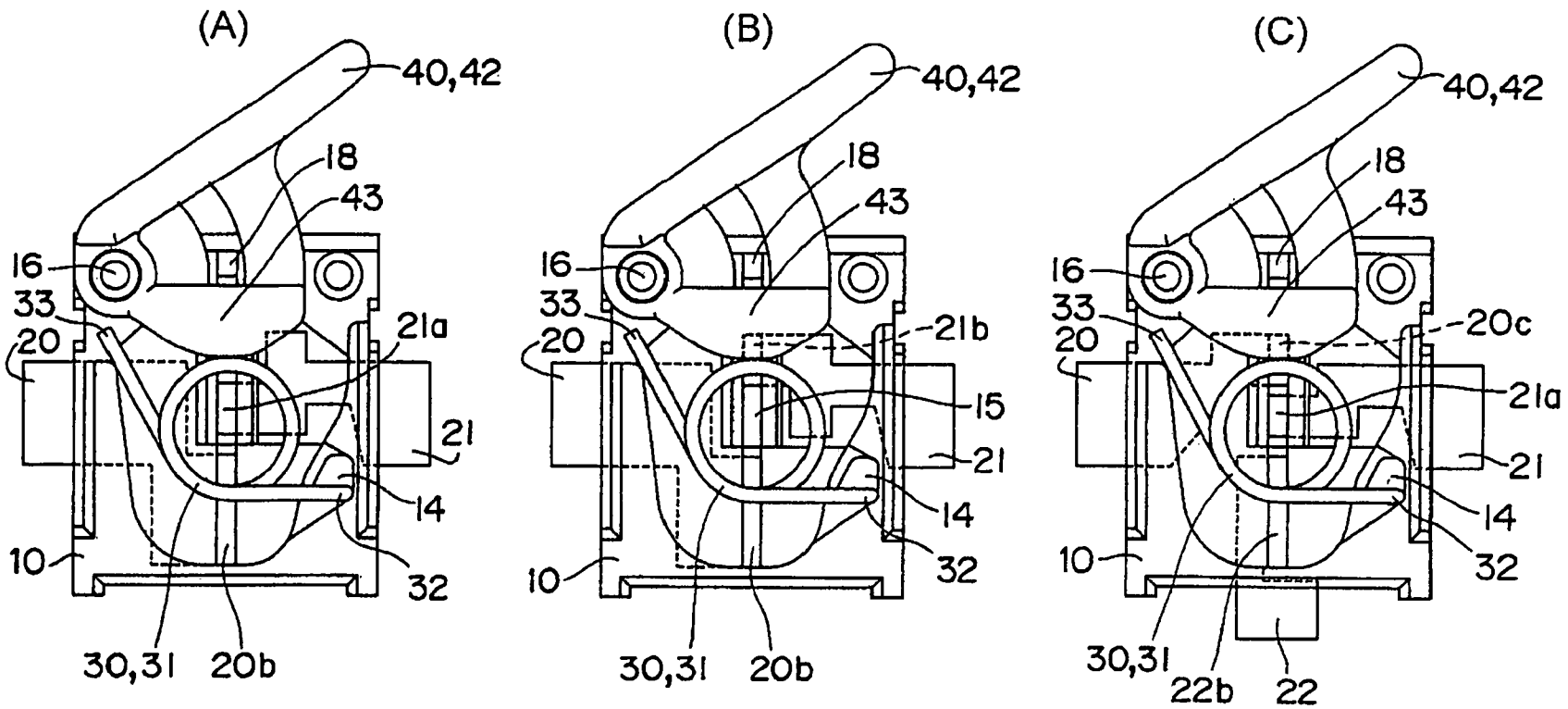
FIGS. 13A, 13B, and 13C are plan views showing seventh, eighth, and ninth embodiments of switches according to the invention.
Figure 14:
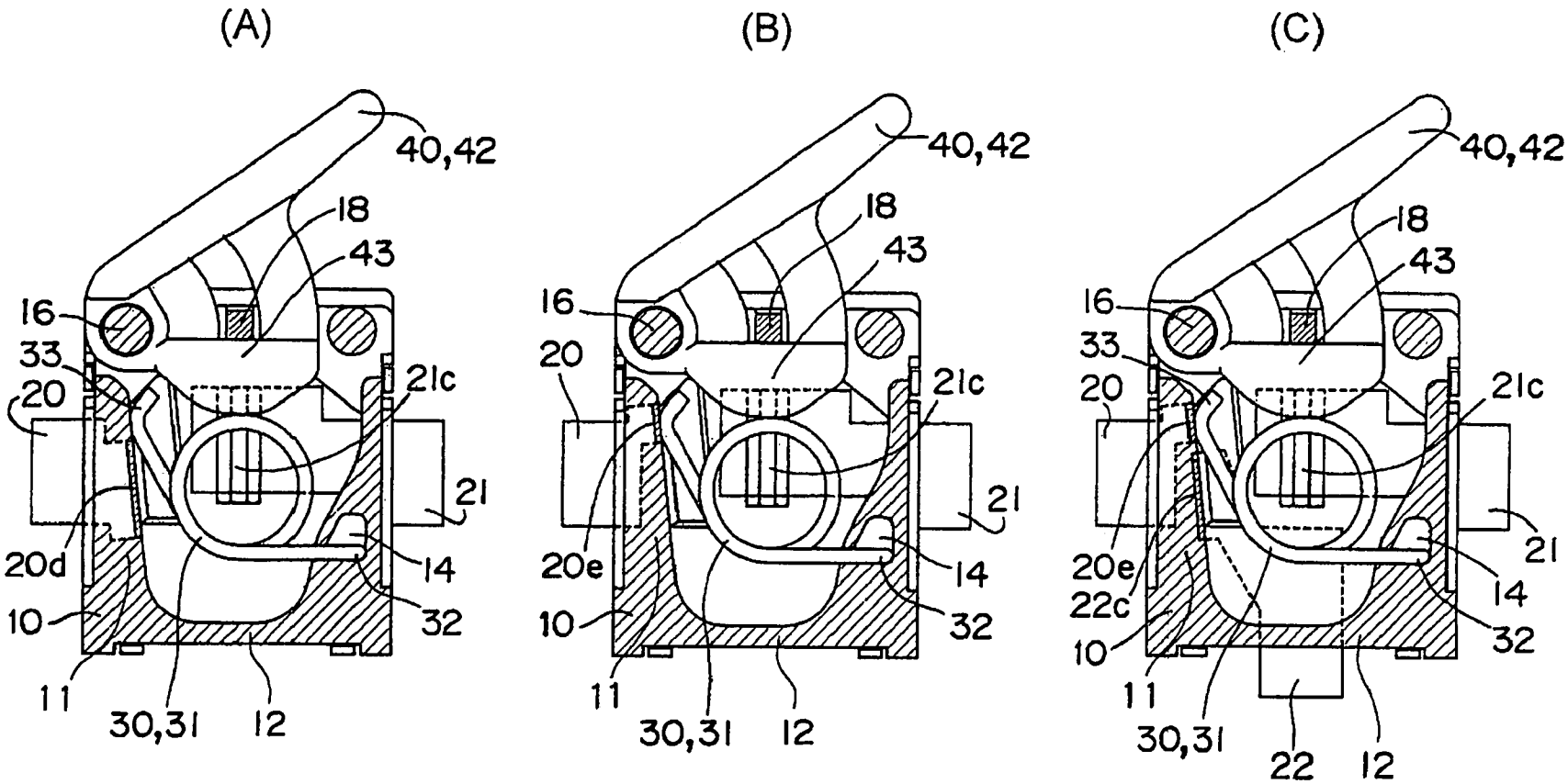
FIGS. 14A, 14B, and 14C are plan views showing tenth, eleventh, and twelfth embodiments of switches according to the invention.
Figure 2:
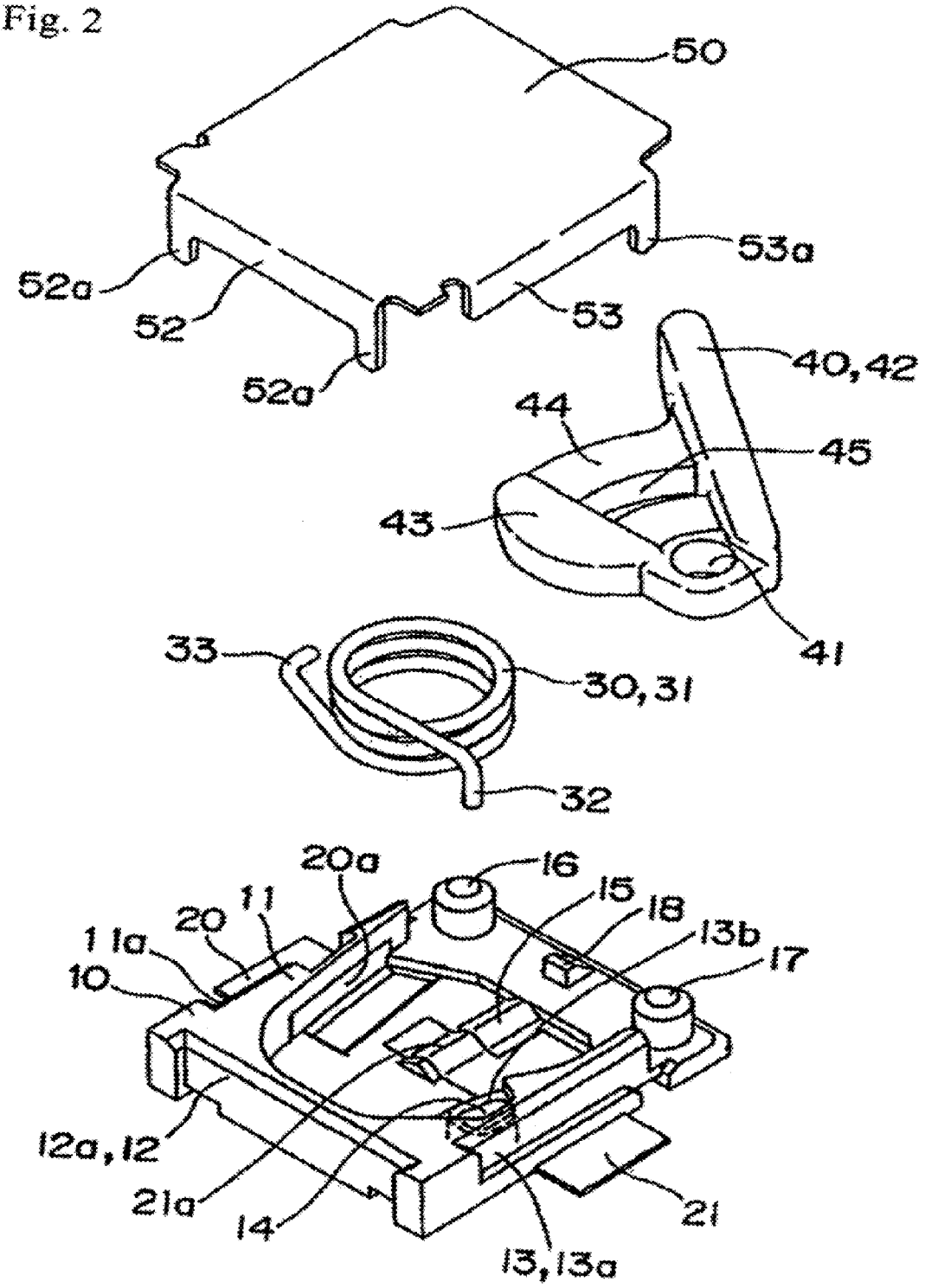

That is, as shown in FIG. 8, a normally closed stationary contact 21*b* is exposed to a surface of a ridge 15 protrusively provided on a bottom surface of the base 10. As shown in FIGS. 9 to 11, when an operating lever 40 is pushed in, a torsional moment acting on a coil portion 31 increases, so that the coil portion 31 slides on the surface of the ridge 15 while the other end 33 slides on a common stationary contact 20*a*. Therefore, the coil portion 31 of a moving contact piece 30 having come into pressure contact with the normally closed stationary contact 21*b* is opened relative to the closed stationary contact 21*b*. When a load on the operating lever 40 is released, the operating lever 40 is pushed back outward by the spring force of the moving contact piece 30 to return to an original position. Since the rest is the same as that in the embodiment described above, the same parts as those in the latter are denoted by the same reference numerals as those in the latter, and an explanation therefor is omitted.

According to a third embodiment, a common stationary contact 20*a* is exposed to an inner surface of a side wall 11 and a normally closed stationary contact 21*b* and a normally opened stationary contact 22*a* are arranged on a bottom surface of a base 10 as shown in FIG. 7C.

Accordingly, when an operating lever 40 is pushed in, a torsional moment acting on a coil portion 31 of a moving contact piece 30 increases, so that the moving contact piece turns about an end 32 whereby the other end 33 slides on a common stationary contact 20*a*, and the coil portion 31 of a moving contact piece 30 having come into pressure contact with a normally closed stationary contact 21*b* contacts with a normally opened stationary contact 22*a* to perform contact switchover. Since the rest is the same as that in the embodiment described above, the same parts as those in the latter are denoted by the same reference numerals as those in the latter, and an explanation therefor is omitted.

According to a fourth embodiment, a common stationary contact 20*b* and a normally opened stationary contact 21*a* are arranged on a bottom surface of a base 10 as shown in FIG. 12A.

According to the embodiment, the common stationary contact 20*b* and the normally opened stationary contact 21*a* are arranged in the same level on the bottom surface of the base 10. Therefore, a coil portion 31 of a moving contact piece 30 contacts with the stationary contacts 20*b*, 21*a* at substantially the same contact pressure, so that there is an advantage that dispersion is hard to generate in operating characteristics.

Likewise, as shown in FIG. 12B, a common stationary contact 20*b* and a normally closed stationary contact 21*b* may be arranged in the same level on the bottom surface of the base 10 (a fifth embodiment). Also, as shown in FIG. 12C, a common stationary contact 22*b*, a normally closed stationary contact 20*c*, and a normally opened stationary contact 21*a* may be arranged on a bottom surface of a base 10 (a sixth embodiment).

Like the fourth embodiment described above, the fifth and sixth embodiments have an advantage that a switch can be obtained, in which dispersion in contact pressure does not generate and which has a stable operating characteristics.

In addition, with the fourth to sixth embodiments described above, the other end 33 of the moving contact piece 30 is not needed to slide on a stationary contact provided on the inner surface of the base 10. Therefore, as in a seventh embodiment to a ninth embodiment shown in FIGS. 13A to 13C, respectively, the other end 33 of a moving contact piece 30 is not bent but may extend straight.

According to a tenth embodiment, a common stationary contact 21*c* is provided on a bottom surface of a base 10 while a normally opened stationary contact 20*d* is provided on an inner surface of a side wall 11 of the base 10 as shown in FIG. 14A.

According to the embodiment, when an operating lever 40 is pushed in, a drive part 43 thereof pushes a coil portion 31, so that a torsional moment acting on the coil portion 31 increases. Therefore, the coil portion 31 turns about an end 32 to slide on the common stationary contact 21*c* and the other end 33 contacts with the normally opened stationary contact 20*d*. When a load on the operating lever 40 is released, the operating lever 40 is restored by the spring force of the moving contact piece 30. Since the rest is the same as that in the embodiment described above, the same parts as those in the latter are denoted by the same reference numerals as those in the latter, and an explanation therefor is omitted.

In addition, like the tenth embodiment described above, a normally closed stationary contact 20*e* may be provided on an inner surface of a side wall 11 of the base 10 as shown in FIG. 14B or FIG. 14C (an eleventh embodiment), and a normally closed stationary contact 20*e* and a normally opened stationary contact 22*c* may be provided (a twelfth embodiment).

In addition, according to the embodiments, both an operation in a clockwise direction and an operation in a counterclockwise direction can be accommodated by changing a position, in which the operating lever 40 is mounted to the base 10.

Also, while according to the embodiments, an end of the moving contact piece extending from above is supported pivotally on the base, the other end thereof extending from under may be supported pivotally on the base.

The switch according to the invention is of course applicable to a switch other than ones according to the embodiments.

What is claimed is:

1. A switch comprising a base, a moving contact piece made of a coil spring and having one end thereof supported pivotally on the base, an operating lever having one end thereof supported pivotally on the base and having a drive part, which extends from the one end, pushing a coil portion of the moving contact piece, and a cover having a planar shape capable of covering the base and fixed to the base to compress the coil portion, and wherein the operating lever pushes the coil portion of the moving contact piece to give thereto a torsional moment whereby the moving contact piece turns about an end thereof, the coil portion of the moving contact piece slides on at least one stationary contact exposed from a bottom surface of the base, and the other end of the moving contact piece slides on a common stationary contact exposed from an inner surface of the base.

2. The switch according to claim 1, wherein the stationary contact exposed from the bottom surface of the base comprises a normally opened stationary contact.

3. The switch according to claim 1, wherein the stationary contact exposed from the bottom surface of the base comprises a normally closed stationary contact.

4. The switch according to claim 1, wherein the stationary contact exposed from the bottom surface of the base comprises a normally opened stationary contact and a normally closed stationary contact.

5. A switch comprising a base, a moving contact piece made of a coil spring and having one end thereof supported pivotally on the base, an operating lever having one end thereof supported pivotally on the base and having a drive part, which extends from the one end, pushing a coil portion of the moving contact piece, and a cover having a planar shape capable of covering the base and fixed to the base to compress the coil portion, and wherein the operating lever pushes the coil portion of the moving contact piece to give thereto a torsional moment whereby the moving contact piece turns about an end thereof, the coil portion of the moving contact piece slides on a common stationary contact exposed from a bottom surface of the base, and the other end of the moving contact piece slides on at least one stationary contact exposed from an inner surface of the base.

6. The switch according to claim 5, wherein the stationary contact exposed from the inner surface of the base comprises a normally opened stationary contact.

7. The switch according to claim 5, wherein the stationary contact exposed from the inner surface of the base comprises a normally closed stationary contact.

8. The switch according to claim 5, wherein the stationary contact exposed from the inner surface of the base comprises a normally opened stationary contact and a normally closed stationary contact.

9. A switch comprising a base, a moving contact piece made of a coil spring and having one end thereof supported pivotally on the base, an operating lever having one end thereof supported pivotally on the base and having a drive part, which extends from the one end, pushing a coil portion of the moving contact piece, and a cover having a planar shape capable of covering the base and fixed to the base to compress the coil portion, and wherein the operating lever pushes the coil portion of the moving contact piece to give thereto a torsional moment whereby the moving contact piece turns about an end thereof, the coil portion of the moving contact piece slides on at least two stationary contacts exposed from a bottom surface of the base, and the other end of the moving contact piece slides on an inner surface of the base.

10. The switch according to claim 9, wherein at least two stationary contacts exposed from the bottom surface of the base comprise a common stationary contact and a normally opened stationary contact.

11. The switch according to claim 9, wherein at least two stationary contacts exposed from the bottom surface of the base comprise a common stationary contact and a normally closed stationary contact.

12. The switch according to claim 9, wherein at least two stationary contacts exposed from the bottom surface of the base comprise a common stationary contact, a normally opened stationary contact, and a normally closed stationary contact.

13. A switch comprising a base, a moving contact piece made of a coil spring and having one end thereof supported pivotally on the base, an operating lever having one end thereof supported pivotally on the base and having a drive part, which extends from the one end, pushing a coil portion of the moving contact piece, and a cover having a planar shape capable of covering the base and fixed to the base to compress the coil portion, and wherein the operating lever pushes the coil portion of the moving contact piece to give thereto a torsional moment whereby the moving contact piece turns about an end thereof, the coil portion of the moving contact piece slides on at least two stationary contacts exposed from a bottom surface of the base, and the other end of the moving contact piece comes into pressure contact with an inner surface of the base.

14. The switch according to claim 13, wherein at least two stationary contact exposed from the bottom surface of the base comprises a common stationary contact and a normally opened stationary contact.

15. The switch according to claim 13, wherein at least two stationary contact exposed from the bottom surface of the base comprises a common stationary contact and a normally closed stationary contact.

16. The switch according to claim 13, wherein at least two stationary contacts exposed from the bottom surface of the base comprise a common stationary contact, a normally opened stationary contact, and a normally closed stationary contact.

* * * * *

UNITED STATES PATENT AND TRADEMARK OFFICE

CERTIFICATE OF CORRECTION

PATENT NO. : 7,365,283 B2
APPLICATION NO. : 11/415449
DATED : April 29, 2008
INVENTOR(S) : Yasuhiro Kiyono et al.

Figure 2:
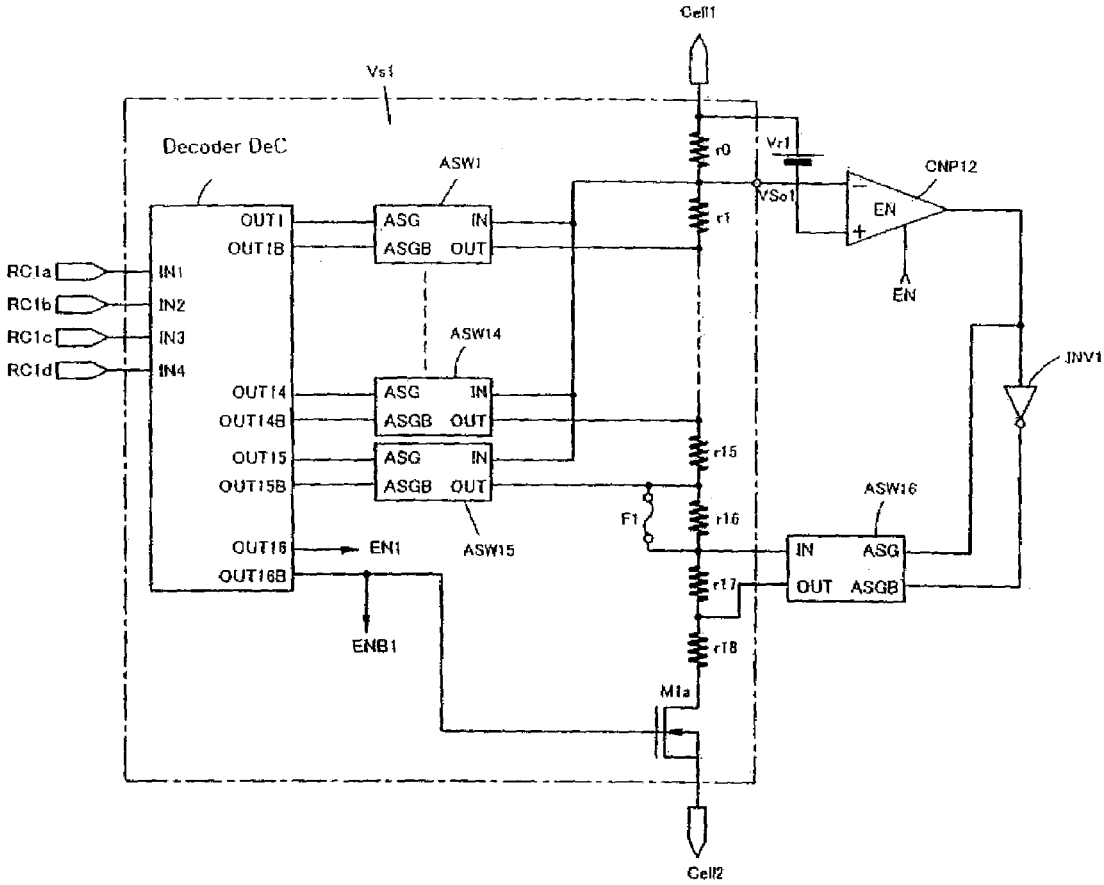
FIG. 2 is an exploded, perspective view showing the switch shown in FIG. 1A.
Figure 3:
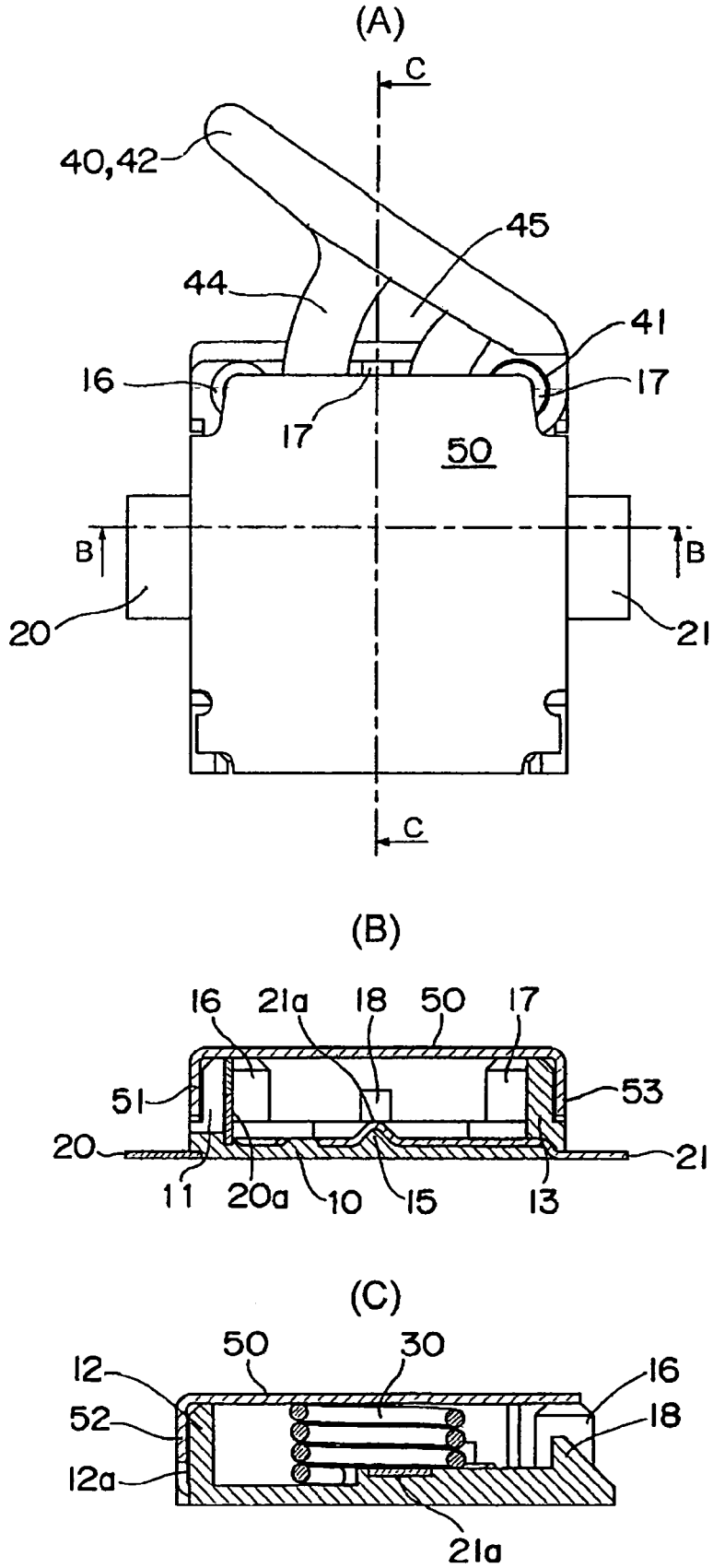
FIG. 3A is a plan view showing the switch shown in FIG. 1A, and FIGS. 3B and 3C are a schematic, cross sectional view taken along the line B-B in FIG. 3A and a schematic, cross sectional view taken along the line C-C.
Figure 4:
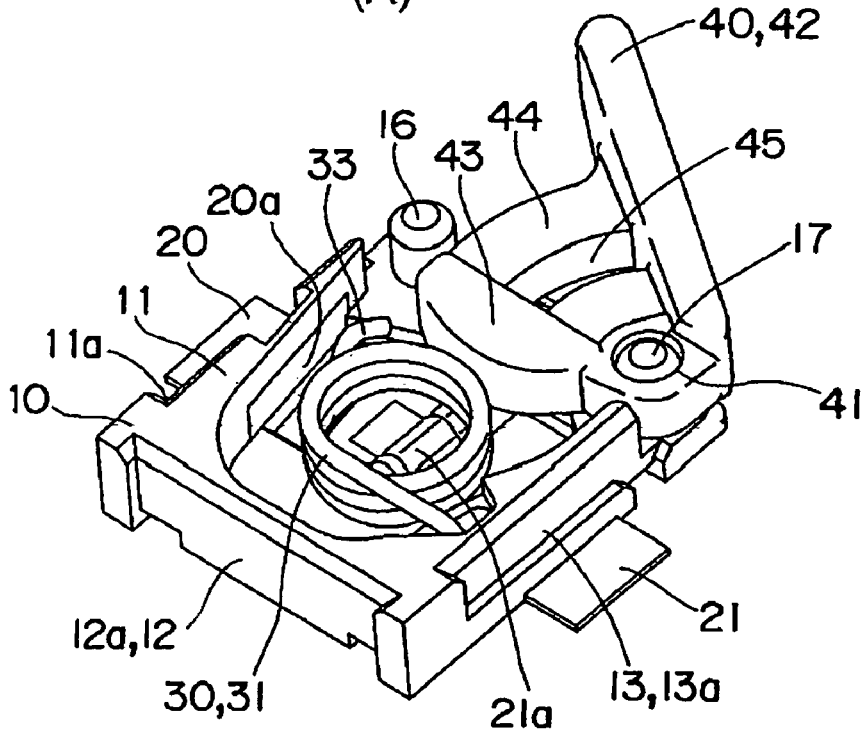
FIGS. 4A and 4B are perspective-views showing the switch shown in FIG. 1A before and after operation.
Figure 4:
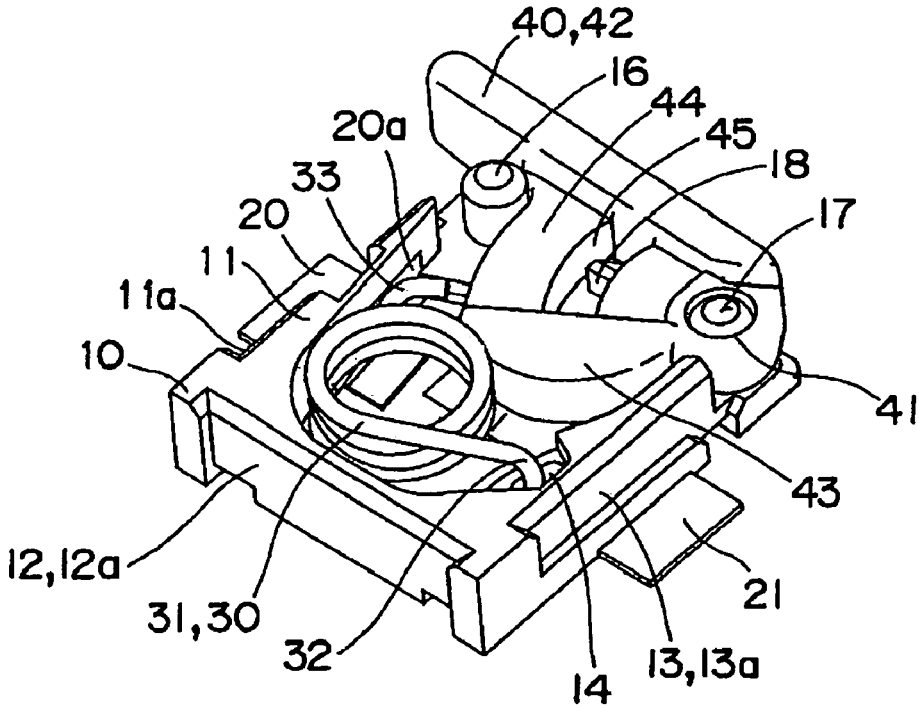
Figure 5:
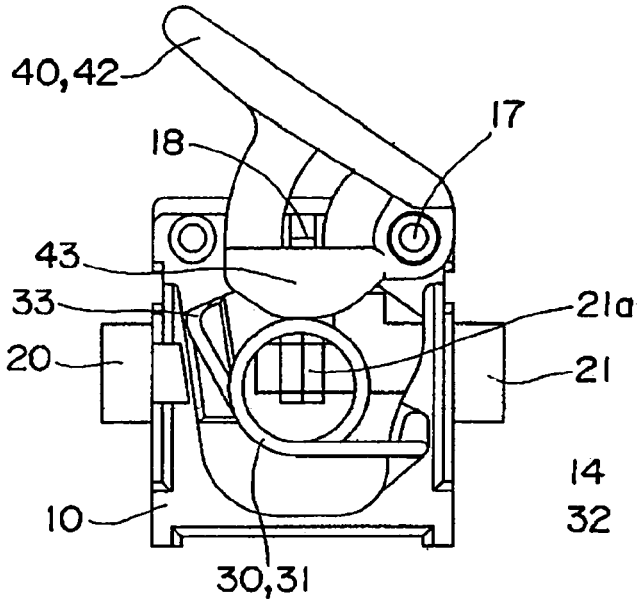
FIGS. 5A, 5B, and 5C are plan views showing the switch shown in FIG. 1A before, during, and after operation.
Figure 5:
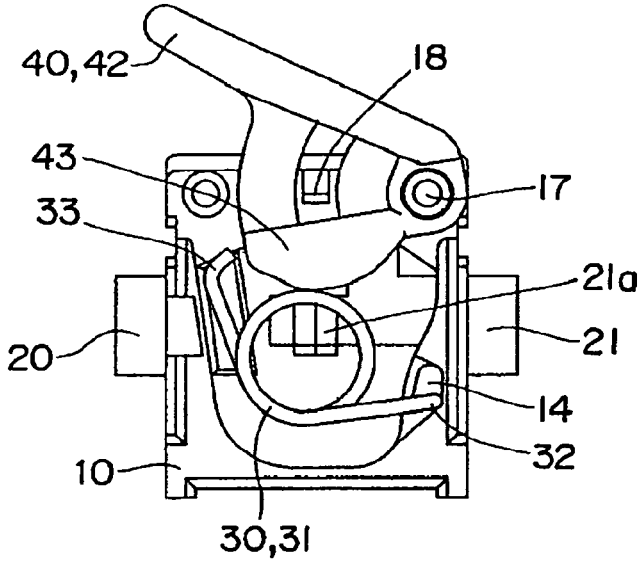
Figure 5:
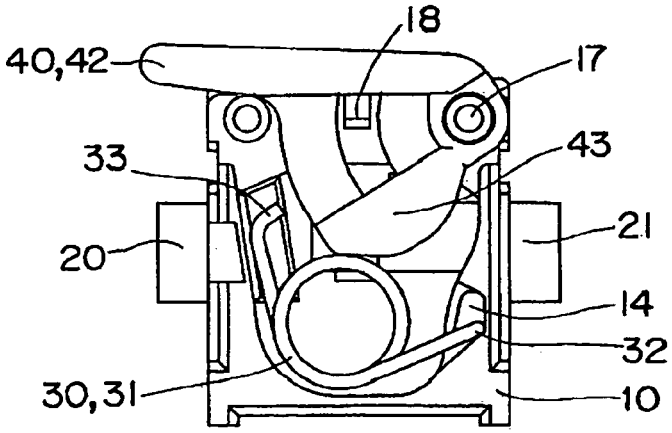
Figure 6:
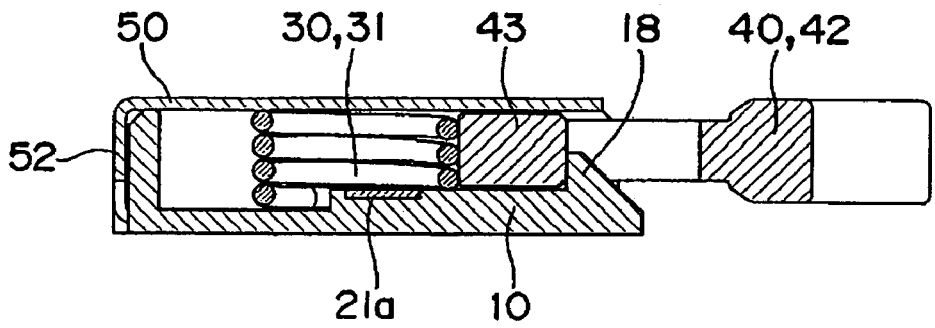
FIGS. 6A, 6B, and 6C are cross sectional views showing the switch shown in FIG. 1A before, during, and after operation.
Figure 6:
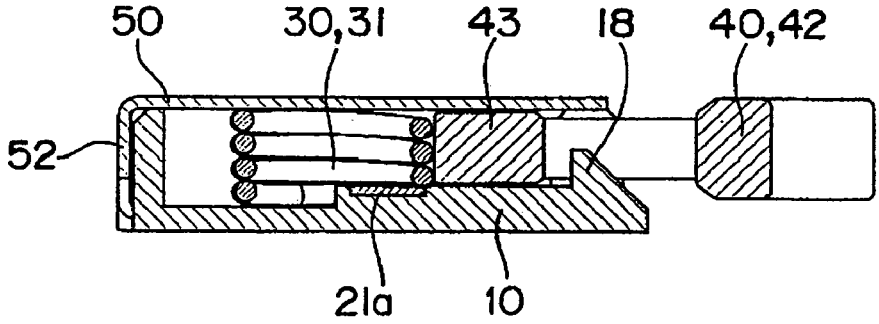
Figure 6:
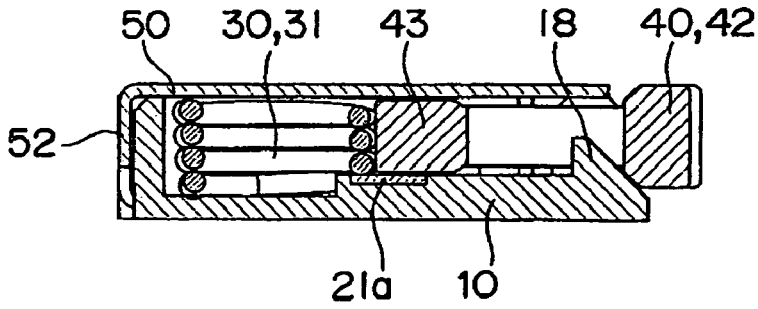
Figure 7:
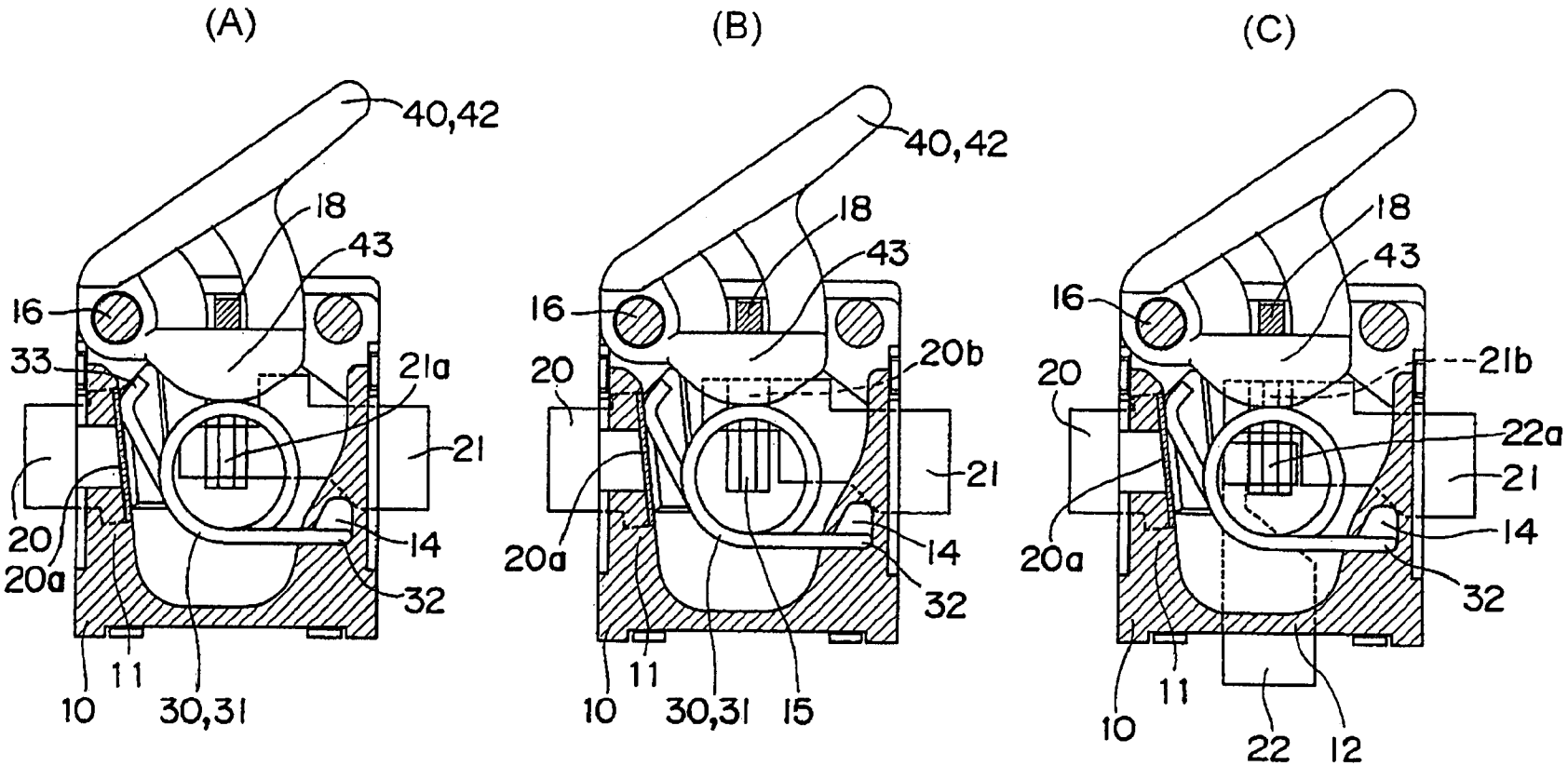
FIG. 7A is a horizontal, cross sectional view showing an example of different use of the first embodiment.
FIGS. 7B and 7C are horizontal, cross sectional views showing a second embodiment and a third embodiment.

It is certified that error appears in the above-identified patent and that said Letters Patent is hereby corrected as shown below:

In the Drawings:

In the Drawings, the Title Page and sheet 2 of 14, figure 2, is incorrect. Please replace the drawing with the formal drawing attached.

Signed and Sealed this

Twenty-ninth Day of July, 2008

JON W. DUDAS
*Director of the United States Patent and Trademark Office*

(12) United States Patent
Kiyono et al.

(10) Patent No.: US 7,365,283 B2
(45) **Date of Patent: *Apr. 29, 2008**

(54) SWITCH

(75) Inventors: Yasuhiro Kiyono, Nagaokakyo (JP); Toshihiro Naruo, Kyoto (JP); Yasuhiro Sakashita, Nara (JP)

(73) Assignee: Omron Corporation, Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/415,449

(22) Filed: May 1, 2006

(65) Prior Publication Data

US 2006/0254889 A1 Nov. 16, 2006

(30) Foreign Application Priority Data

May 2, 2005 (JP) ..... 2005-134231

(51) Int. Cl.
*H01H 15/02* (2006.01)

(52) U.S. Cl. ..... 200/563; 200/553; 200/559; 200/276.1

(58) Field of Classification Search .... 200/16 R–16 D, 200/520, 530–536, 553, 557–559, 561–563, 200/276.1, 61.82

See application file for complete search history.

(56) References Cited

FOREIGN PATENT DOCUMENTS

| | | |
|---|---|---|
| EP | 1 261 002 | 11/2002 |
| JP | 61-51623 | 4/1986 |
| JP | 61-71934 | 5/1986 |
| JP | 62-86034 | 6/1987 |
| JP | 64-23823 | 2/1989 |
| JP | 8-55538 | 2/1996 |
| JP | 2002-42610 | 2/2002 |
| JP | 2004-327115 | 11/2004 |
| WO | WO-02/37517 | 5/2002 |

OTHER PUBLICATIONS

Patent Abstracts of Japan, Publication No. 2004-327115, Publication Date: Nov. 18, 2004, 14 pages.
Japanese Office Action for Japanese Patent Application No. 2005-134231, issued Apr. 10, 2007, and English translation thereof 6 pages.
Japanese Office Action for Japanese Patent Application No. 2005-134231, dated Aug. 21, 2007, and English Translation thereof, 13 pages.

*Primary Examiner*—Michael A Friedhofer
(74) *Attorney, Agent, or Firm*—Osha Liang LLP

(57) ABSTRACT

A switch is provided, which is stable in operating characteristics and can be operated with a small operating force, and which is long in life and easy to manufacture. The switch includes a base, a moving contact piece having one end thereof supported pivotally on the base, an operating lever supported pivotally on the base and having a drive part pushing a coil portion of the moving contact piece, and a cover having a planar shape capable of covering the base and fixed to the base to compress the coil portion. The operating lever pushes the coil portion of the moving contact piece whereby the moving contact piece turns about an end thereof, the coil portion slides on a stationary contact exposed from a bottom surface of the base, and the other end of the moving contact piece slides on a common stationary contact exposed from an inner surface of the base.

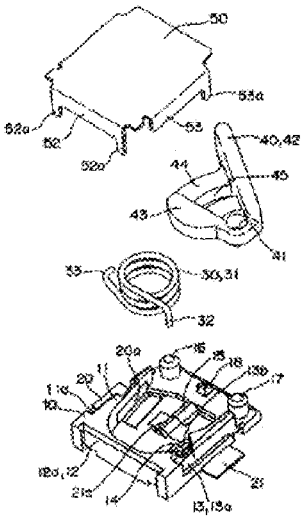

16 Claims, 14 Drawing Sheets